US006264197B1

(12) United States Patent
Halliburton

(10) Patent No.: US 6,264,197 B1
(45) Date of Patent: Jul. 24, 2001

(54) DOZER PUSHER AMUSEMENT GAME

(75) Inventor: Ronald D. Halliburton, Delray Beach, FL (US)

(73) Assignee: Benchmark Entertainment LC, Hypoluxo, FL (US)

( * ) Notice: Subject to any disclaimer, the term of this patent is extended or adjusted under 35 U.S.C. 154(b) by 0 days.

(21) Appl. No.: 09/522,993

(22) Filed: Mar. 9, 2000

Related U.S. Application Data

(60) Provisional application No. 60/123,450, filed on Mar. 9, 1999.

(51) Int. Cl.[7] ..... A63F 7/00

(52) U.S. Cl. ..... 273/138.2; 273/139.4; 273/445

(58) Field of Search ..... 273/138.1, 138.2, 273/138.3, 144 R, 451, 459, 448, 445

(56) References Cited

U.S. PATENT DOCUMENTS

| | | | | |
|---|---|---|---|---|
| 4,496,160 | * | 1/1985 | Wichinsky et al. | 273/138.2 X |
| 4,662,636 | * | 5/1987 | Crompton | 273/138.2 |
| 5,275,402 | * | 1/1994 | Malavazos et al. | 273/138.3 X |
| 5,507,490 | * | 4/1996 | Hagiwara | 273/138.3 X |
| 5,553,865 | * | 9/1996 | Shoemaker, Jr. et al. | 273/448 |
| 5,622,366 | * | 4/1997 | Inoue | 273/138.2 |
| 5,775,691 | * | 7/1998 | Hamano | 273/138.2 |
| 5,785,314 | * | 7/1998 | Hamano | 273/138.3 |

FOREIGN PATENT DOCUMENTS

| | | | | |
|---|---|---|---|---|
| 2114452 | * | 8/1983 | (GB) | 273/138 R |
| 2124913 | * | 2/1984 | (GB) | 273/138 A |
| 2144643 | * | 3/1985 | (GB) | 273/138 A |

* cited by examiner

*Primary Examiner*—Raleigh W. Chiu
(74) *Attorney, Agent, or Firm*—Andrew C. Aitken; Venable Baetjer Howard & Civiletti, LLP

(57) ABSTRACT

A coin operated amusement device that includes a coin acceptor that directs coins down a coin chute and delivers the coins to a playing surface. A series of moveable pushers are oriented on the playing surface and push coins on the surface toward a ledge. The distance the pusher will travel toward the ledge is dependent on the timing of the insertion of the coin into the acceptor with respect to a moving indicator that constantly sweeps back and forth across a gauge. The pushers may be advanced independently or in unison. The object of the game is to time the insertion of coins so that the pusher will travel a maximum distance and push coins off the ledge.

16 Claims, 4 Drawing Sheets

DOZER PUSHER AMUSEMENT GAME

The applicant claims the benefit of the filing date of the provisional application U.S. Pat. No. 60/123,450 filed on Mar. 9, 1999. The present invention relates to a coin-actuated amusement device and more particularly to a new pusher game which further involves a timing feature where the forward progress of the pusher is dependant on the time when the coin is dropped onto the play field.

BACKGROUND OF THE INVENTION

There are numerous coin-actuated devices which involve dropping a coin onto a flat play surface at a location where it contacts a pusher and the pusher then moves the coin which in turn contacts other coins located near the periphery of a ledge and causes coins located at the edge of the ledge to fall into a hopper. These games are often referred to in the amusement game industry as pusher games. In conventional pusher games, a horizontal bar moves in a reciprocating motion at a constant rate and a constant distance over a flat playing surface and continuously sweeps a fixed area free of coins. This area is referred to in this application as the footprint. The coins within the footprint are pushed progressively toward a ledge where they fall into a hopper. Typically, pusher games use two hoppers: first, a player hopper, which directs the coins back to the player (or are counted and the player is awarded a commensurate number of tickets for redemption), and second, a house hopper which retains the coins for the owner of the machine or amusement facility. The object of these games is to drop a coin on the play surface so that the pusher will engage the dropped coin and push it toward the ledge causing the coin engaged by the pusher to push other coins and cause coins on the edge of the ledge to fall into the player's hopper. The player attempts to drop his coins so that the maximum number of coins will fall from the ledge into the player's hopper. Most games of this class of game allow a player to control the location of the coin drop to the play surface to some extent by providing a chute which can be moved over the footprint area. Further, the drop can be timed so that the coin will drop onto the fixed footprint area when it is at its maximum area. In most prior art games the pushers move at a constant distance and a relatively constant slow pace. Some games involve multiple pushers which move in a predetermined and predicable sequence.

DETAILED DESCRIPTION OF THE INVENTION

Figure 1:
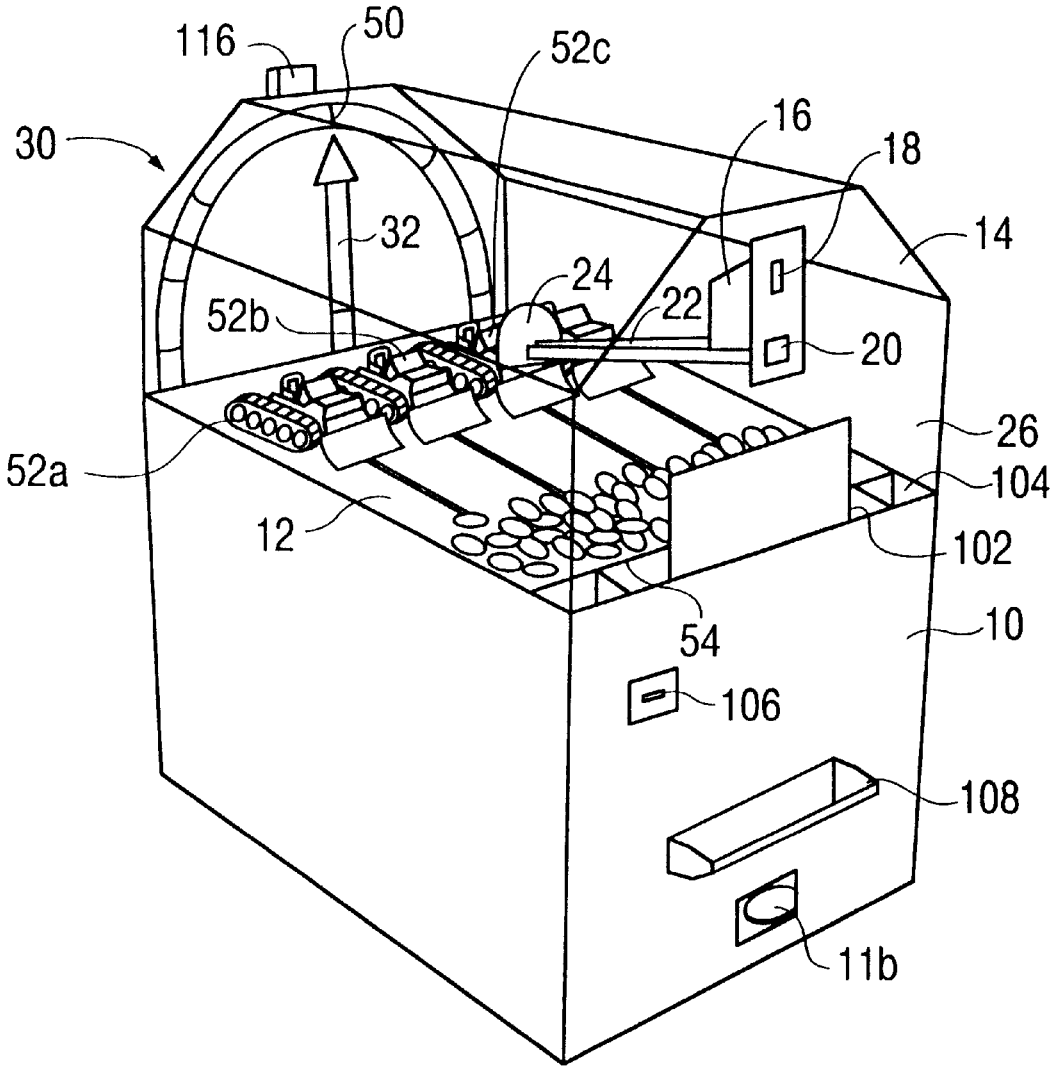
FIG. 1 is a perspective view of a first embodiment of a device according to the invention.
Figure 2:
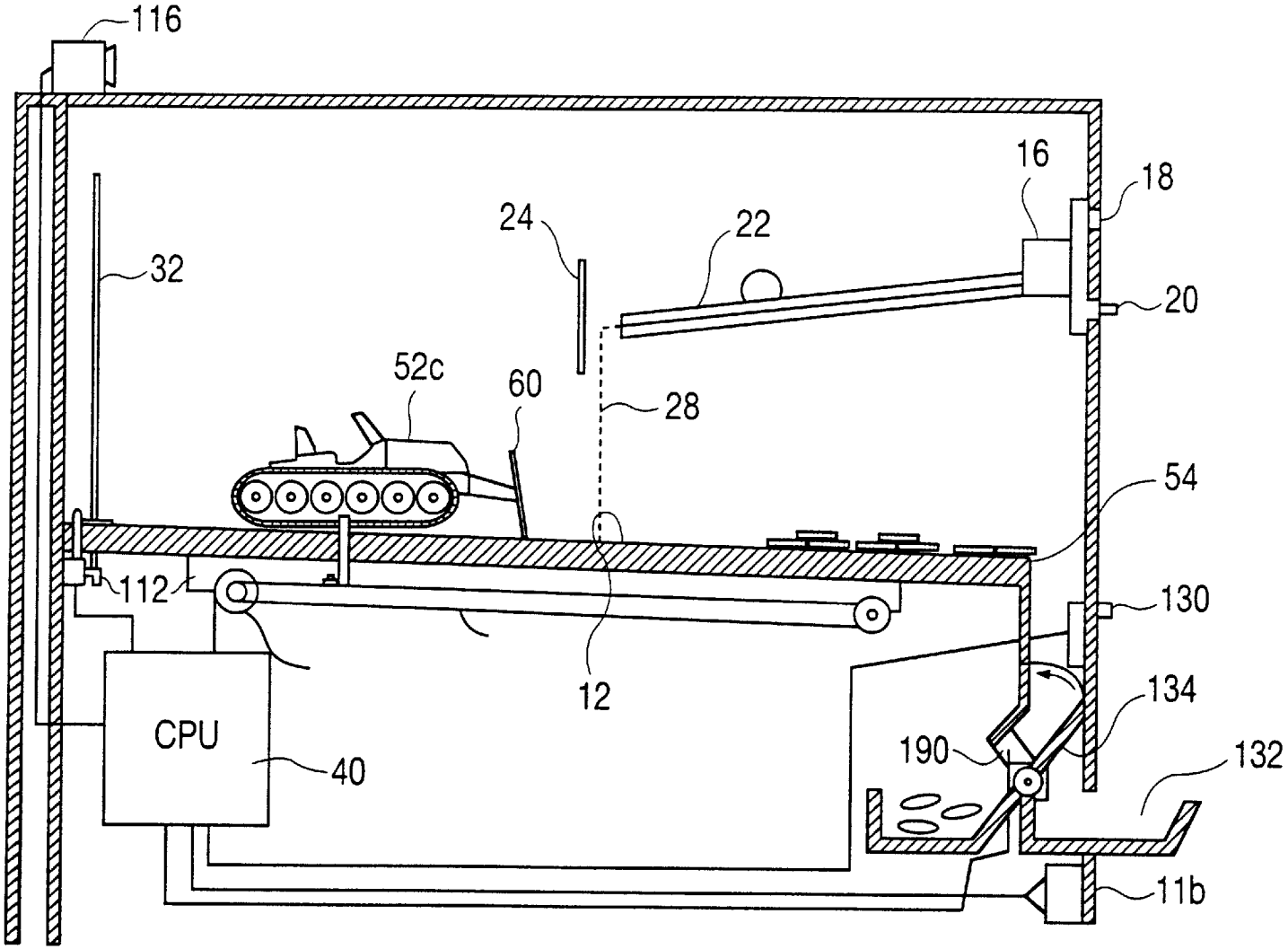
FIG. 2 is a side sectional view in elevation of the invention.

Now referring to FIG. 1, depicted is an amusement game according to the invention which has a bottom cabinet 10 which supports a play surface 12 enclosed by transparent cover 14. In the front of cover 14 is a coin acceptor 16 which is designed to accept coins or tokens through coin slot 18. Spurious coins or tokens are returned to the player in receptacle 20. If the coin or token is genuine coin acceptor 16 directs the coin to chute 22. Coin chute 22 consists of a floor and two lateral sidewalls and is positioned on an incline to allow coins or tokens to roll down the chute at a consistent speed from the front wall 26 of the cover 14. As best seen in FIG. 2 coins exit the chute 22 and travel along a path 28, hitting target deflector 24 and then dropping to the play surface 12.

Figure 3:
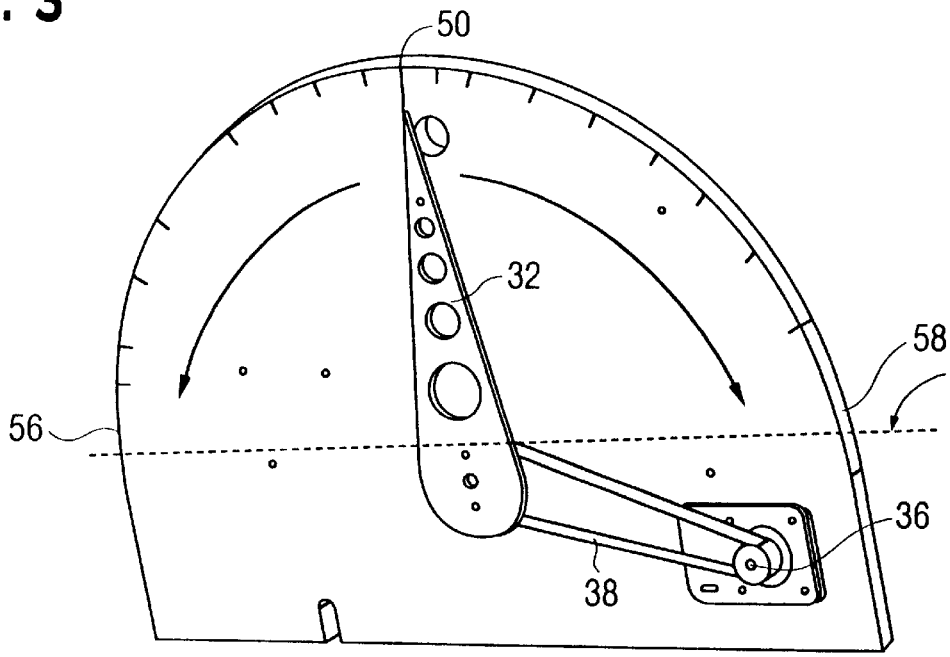
FIG. 3 is a perspective view of the needle and gauge indicator used with the invention.

A player attempts to time the insertion of a coin into the coin slot 18 so as to coincide with the maximum throttle point shown by the gauge 30. The gauge 30, as depicted in FIG. 3, includes a moving indicator needle or pointer 32 which sweeps back and forth across the rear of the cabinet and is driven by belt 38 which is turned by stepper motor 112. The gauge pointer 32 moves at a constant speed of about 20 rpm back and forth across the gauge. Stepper motor 112 is controlled by a central processing unit ("CPU") 40. The object of the game is to try to time the insertion of the coin into slot 18 so that the coin hits the target deflector 24 at the same time pointer 32 is directly vertical or at the "maximum throttle position" 50. If the player accurately times the insertion of the coin so that it hits target deflector 24 to coincide with the pointer at maximum throttle position, one of four possible bulldozer pushers 52, the selection of which is made by the CPU, will advance to a maximum distance down play surface 12 toward the ledge 54 in front of the cabinet. If the coin hits the target when the needle pointer 32 is at lateral position 56 or 58, the preselected bulldozer 52 will travel down a minimum distance toward the front of the cabinet.

In the first embodiment the chute 22 is fixed and the player has no control over the location of the drop onto the playing surface. A coin enters the acceptor and is directed down the coin chute. The time for a coin to travel from the insertion slot to the end of the coin chute is relatively constant. The target deflector 24 prevents the coins from moving or bouncing past the bulldozer pushers and ensures that the coins are directed to the playing surface 12. An array of LEDs are provided on the target deflector 24. When the coin passes through a coin sensor in the coin acceptor mechanism 16 a signal is generated and sent to the CPU. Genuine coins are directed to chute 22. Since the average time for a coin to travel from the sensor to the target deflector is relatively constant, it is previously calculated and stored in the CPU 40. After the previously calculated time has elapsed from the time a coin passes through coin acceptor 16, the CPU stops the moving indicator needle 32 so that it appears to the user as if the coin hitting the target has caused the pointer of the gauge to stop. A separate target impact detection mechanism is not needed. Likewise, the CPU illuminates the LEDs on the target deflector so that it appears that the coin hitting the target has caused the LEDs to illuminate.

On the target deflector 24 is a set of LEDs which rotate with a spinning motion. The lights flash when the target is hit by the coin. Although it appears to a player that the impact of the coin striking target deflector 24 causes the lights to flash, this action is controlled the CPU by waiting the previously determined length of time after the coin passes the coin sensor in the coin acceptor mechanism 16. The target deflector is perpendicular with respect to the playing surface 12 and the chute slopes downward from the front of the cabinet. The target deflector is attached to the coin chute or can be suspended from the cover 14.

Next, the position of the pointer is detected by the CPU and the CPU uses this position to retrieve from an internal mathematical table the distance that a predetermined bulldozer will travel which corresponds to that pointer position. If the coin is dropped so the coin hits the target when moving pointer 32 is at the center or middle of the gauge, described as the "full throttle position", one of the bulldozer pushers 52 will move a maximum predetermined distance toward the front of the cabinet. A blade 60 on the front of each bulldozer pusher will push any coins in its path toward a hopper in the front of the cabinet like a conventional pusher game. After the bulldozer advances the predetermined distance it next retreats to the original home position in line with the other bulldozers. Accordingly, the game rewards the skill of the player by correlating the timing of the coin drop with respect to the needle position to the distance the bulldozer pusher will travel. If the player correctly times the drop of the coin the travel distance of the bulldozer pusher will be greatest and the chances that coins will be pushed off the edge of the ledge is high.

In a preferred and first embodiment there are four miniature bulldozers 52*a*, 52*b*, 52*c* and 52*d* provided in each game which serve as the pusher mechanisms. Only one bulldozer will move in response to a coin being played. In this embodiment the bulldozer which moves in response to a coin appears to be random from the perspective of the user, although it is actually controlled by a preselected order which is composed of a long sequence of instructions so that the order does not appear obvious from a player's perspective. The selection of the bulldozer pusher may be achieved by using other techniques such as by using a random number generator or by correlating the selection of the bulldozer pusher to the number of coins or tickets paid out. In another embodiment, the selection of the bulldozer pusher which will advance in response to a coin can be set to progress in sequential order.

Figure 4:
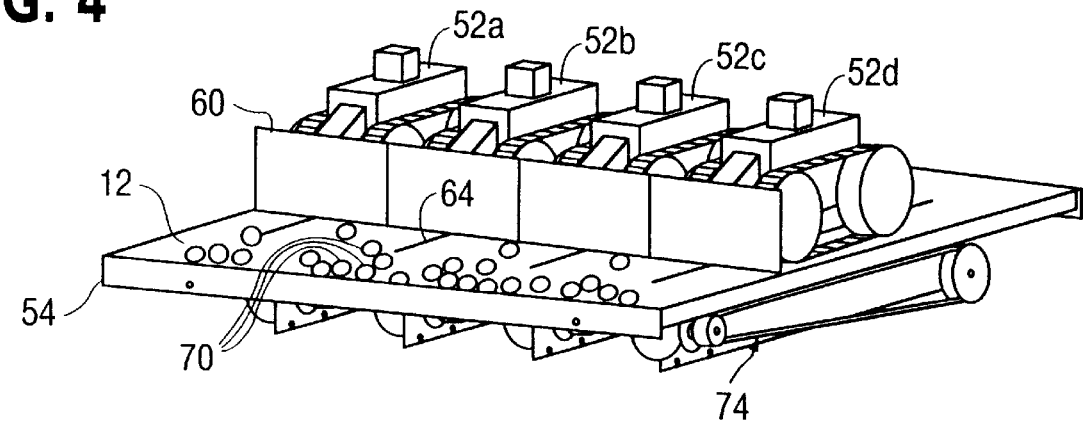
FIG. 4 is a perspective view of the bulldozer pushers on the play field.
Figure 5:
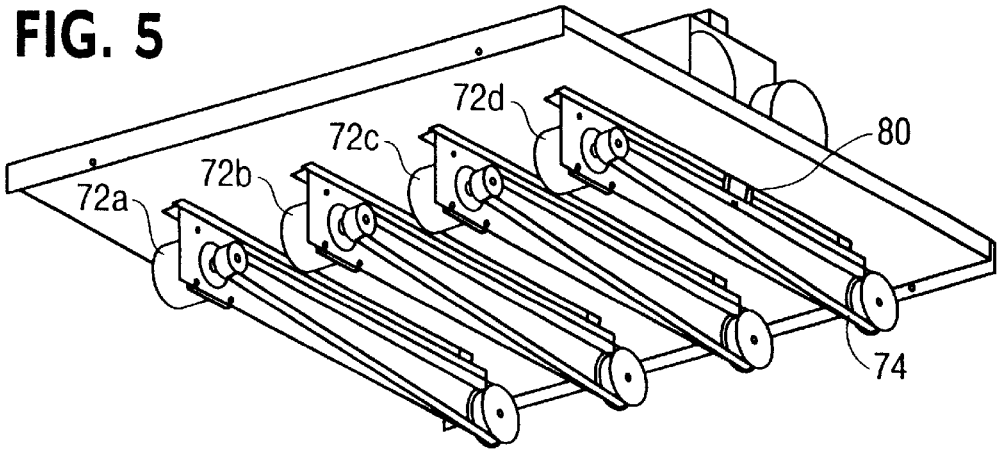
FIG. 5 is a perspective view of the bottom of the play field.

As seen in FIGS. 4 and 5 each bulldozer pusher has a straight track on which it advances a maximum predetermined distance. For example, preselected bulldozer pusher 52*b* will advance up track 64 and engage coins 70 which are on the play surface 12 in front of the bulldozer pusher. The bulldozer pushers are powered by stepper motors 72*a*, 72*b*, 72*c* and 72*d* which are controlled by CPU 40. For example, motion from stepper motor 72*d* is transmitted to endless belt 74*d*. A part 80 attached and fixed to bulldozer 52*d* extends through the track and is fixed to endless belt 74*d* causing the motion of the belt to be transferred to bulldozer 52*d*.

Figure 6:
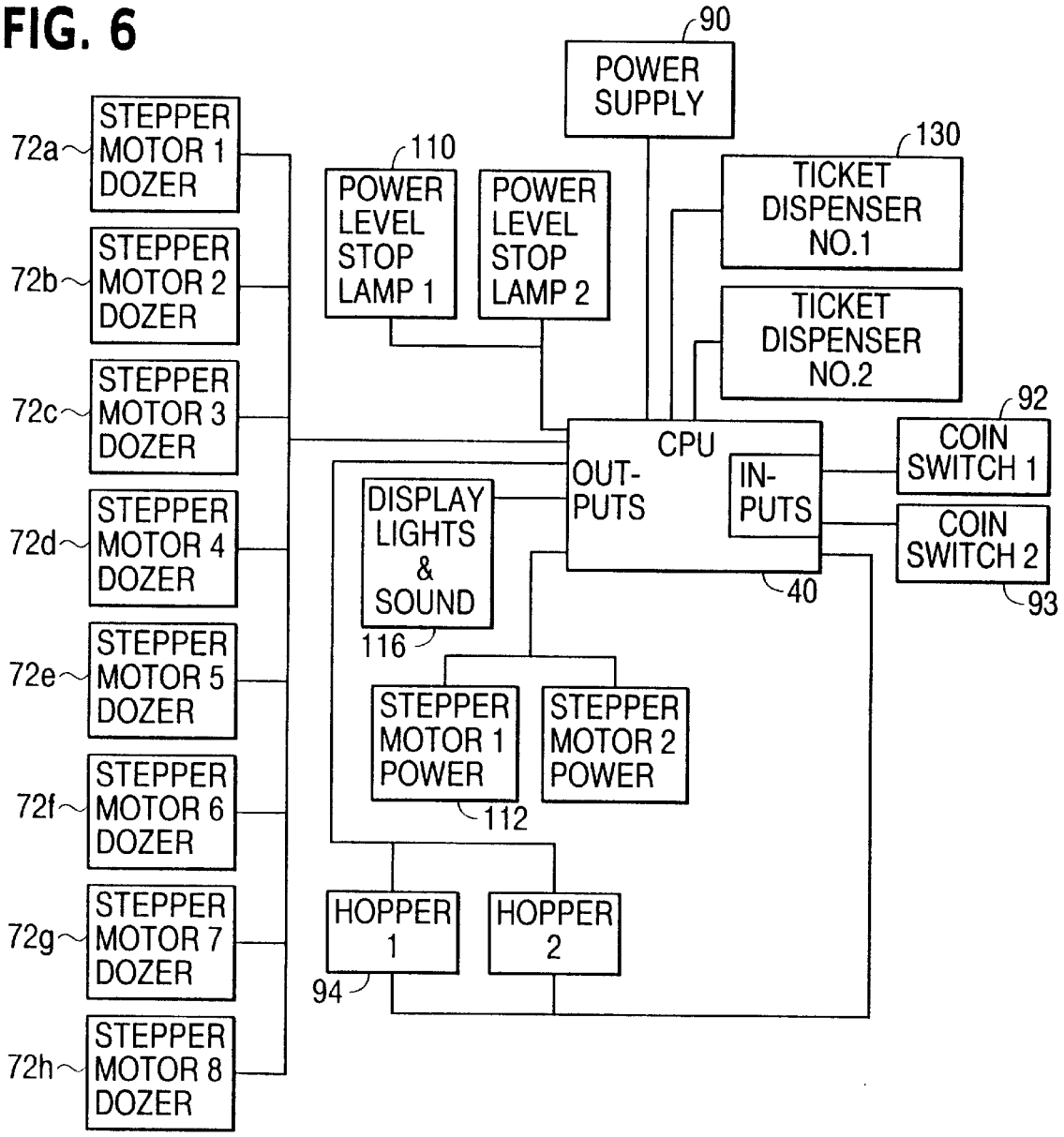
FIG. 6 is a schematic diagram of the electronic components of an embodiment of the invention involving two units.

FIG. 6 is a schematic of the system which uses two, side by side, game units. This arrangement allows two games to share a single CPU and power supply. In FIG. 6 a CPU 40 controls the operation of all electronic functions and is powered by power supply 90. In response to an input from the coin switch 1, reference numeral 92, from unit 1, the CPU will look up the predetermined time in which a coin takes to travels down the coin chute 22 and hit target 24. Upon the elapse of that time the CPU activates the LEDs in target deflector 24, activates power level stop lamp lights 110, for unit 1, and stops the stepper motor 112 momentarily. Power level stop lamp lights are located on the rear of the cabinet and indicate that the coin has been detected and correlated with the position of the moving indicator 32 on the gauge. Stepper motor 112 controls the pointer indicator 32 in unit 1. CPU 40 then looks up the distance for the pointer position and activates one of the motors 72*a*–72*h* for the pusher bulldozers. The selection of the bulldozer motor may be selected by using a random number generator or be based on some input from the player. For example, the selection of the stepper motor may be dependant on the time between coins which are sensed in the coin acceptor or the number of coins detected by coin detectors 94 in the hoppers. In an alternative embodiment, the selection of the bulldozer motor may be predetermined but involve a long sequence of instructions so that it appears from a player's perspective that the selection is random. In yet another alternative the selection may be predictable by following a pattern that can be recognized by a player. The stepper motor is then activated so that the corresponding bulldozer pusher is advanced forward the predetermined distance stored in the CPU and then reverses the motor so that the bulldozer returns to its home position. After the bulldozer pusher is returned to its home position stepper motor 112 is again activated and causes the needle pointer 32 to resume its motion across the rear of the cabinet. Output 116 is also controlled by the CPU and involves light displays and sound effects which are dependant on the timing controlled by the CPU. In a contemplated embodiment sounds are incorporated in the game which include voice feedback which corresponds to the power level scored by the coin drop and sounds of the bulldozers as they move forward across the playing surface. In the event the forward motion of the bulldozer pusher causes coins to drop off the ledge 54 and into one of the hoppers, the coins are detected by detector 94. In one embodiment the number of coins counted is sent to the CPU and the ticket dispenser 130 is instructed to dispense a corresponding number of tickets. In an alternative embodiment the coins which fall into the player's hopper are dispensed directly to the player through an access area 132.

In a contemplated alternative embodiment, the coin chute can be pivoted from a point near the front of the cabinet which allows the player to have more control over the location that the coin will drop from the chute over the play surface.

Now referring back to FIG. 1, in the front of the cabinet are two separate hoppers, a player hopper 102 and a house hopper 104. As coins are pushed over the ledge 54 in the front of the cabinet they fall into either the player hopper 102 or the house hopper 104. In a contemplated to embodiment the player hopper 102 incorporates a conventional coin counter which counts the coins. The counter generates a signal to CPU 40 which then sends a signal to a ticket dispenser 106. Ticket dispenser 106 then dispenses a corresponding number of tickets to the player. In an alternative embodiment, coins which fall into player hopper 102 are returned directly to the player though an access area 132.

Bonus features may be added which increase the number of tickets. For example a bonus can be awarded for causing the coin to hit the target deflector when the pointer 32 is at a certain location or zone on the gauge and additional tickets can be dispensed in response to this condition. Door 134 is an owners option which allows a game to be used either as a ticket redemption game or to directly provide coins to an access area 132. The door is shown at a position where coins are directed to a counter and secure hopper, wherein the counter sends a signal to CPU 40 which then instructs ticket dispenser 130 to distribute a commensurate number of tickets. Tilt sensor and solenoid can be incorporated within the player hopper to prevent tampering with the machine. If the tilt sensor is activated, a solenoid closes a door (not shown) which prevent coins from being accessed or counted in the player hopper.

To play the game, a player inserts a coin or token into slot 18 of coin acceptor 16 and the coin is directed to chute 22, the coin is sensed and a signal is sent to the CPU 40. The coin then rolls down chute 22 and it directed to target 24.

The CPU has looked up the average time for a coin to roll from the sensor to target 24 and sends a signal to the target to illuminate the LEDs simulating a hit. At the same time the CPU looks up the position of the indicator needle 32, and stops stepper 112, an illuminates a display reflecting the position of the indicator needle 32 at the calculated time the coin hit target 24. The coin is directed to playing surface 12. Next the CPU selects which pusher is activated, by a predetermined instruction or random event, and activates the corresponding stepper motor causing the selected bulldozer pusher to advance a distance which is dependent on the location of the pointer 32. The bulldozer pusher moves forward the distance and engages any coins which are in area in which it was instructed to advance. The CPU then reverse the motor to return the bulldozer pusher to the home position. Any coins which fall over the ledge into the player hopper or house hopper are calculated by counter 94 the number is forward to the CPU. The CPU then instructs the ticket dispenser to dispense the a number of ticks which correspond to the number of coins which fall into the player hopper. The CPU then activates stepper motor 112 and the game is ready for the next play.

Although in the preferred embodiment the moving indicator consists of a needle in front of a gauge which sweeps back and forth, other displays could also be employed which the player could use to time the insertion of the coin. For example, the moving indicator may be composed of lights which are sequentially illuminated, a vertically oriented indicator which moves back and forth across the rear of the cabinet, a target on an endless belt or a circular target which rotates. For example a rotating target could be provided with indicia provided thereon which a player attempts to time the passing of the indica on the target with a fixed position. The fixed position could be either in front or behind the target.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. An amusement device comprising a coin acceptor, a playing surface, a coin chute to allow for the delivery of a played coin from said coin acceptor to said playing surface below, said playing surface oriented to retain coins, at least one moveable pusher on said playing surface which moves from a first position along a predetermined path toward a ledge, a moving indicator having a plurality of positions, said positions representing a plurality of distances said pusher can travel across said playing surface toward said ledge, correlation means to correlate the position of said moving indicator to a predetermined distance with a time dependant on the insertion of the coin into said coin acceptor and, an engine to move said pusher said predetermined distance, wherein said pusher will engage any coins in said path and push any said coins toward said ledge.

2. The amusement device as recited in claim 1 further comprising a plurality of hoppers to collect coins falling from said ledge.

3. The amusement device as recite in claim 2 wherein at least one said hopper comprises a player hopper and at least one said hopper comprises a house hopper, wherein coins which fall into said player hopper are used to award said player and coins which fall into said house hopper are retained by the owner or operator of the machine.

4. The amusement device as recited in claim 3 further comprising a ticket dispenser and said player hopper further incorporate a coin counter wherein coins which fall into said player hopper are counted by said counter and a player is provided a number of tickets based upon the number of coins counted.

5. The amusement device as recited in claim 1 wherein said correlation means comprises a central processing unit (CPU).

6. The coin-operated amusement device as recited in claim 5 further comprising a plurality of pushers wherein only one of said pushers is selected by said CPU to be activated and move in response to insertion of a coin.

7. The amusement device as recited in claim 6 wherein the selection of a pusher which is activated and moved is predetermined and predictable by the player.

8. The amusement game as recited in claim 6 wherein the selection of a pusher which is activated and moved is predetermined by said CPU however the selection appears random to a player due to the long sequence of instructions.

9. The amusement game as recited in claim 6 wherein the selection of a pusher is random and said random sequence is determined by said CPU and a player input.

10. The amusement game as recited in claim 6 wherein a plurality of pushers are moved in response to a command from said CPU.

11. The amusement game as recited in claim 1 wherein said moving indicator is a pointer needle which sweeps back and forth across a gauge and the distance the said pusher will travel is dependant on the location of the said pointer needle with respect to said gauge at said time.

12. The amusement game as recited in claim 1 when said pusher resemble miniature bulldozers.

13. The amusement device as recited in claim 1 wherein said coin chute is fixed with respect to said playing surface.

14. The amusement game as recited in claim 1 wherein the position of a lower and distal end of said coin chute is moveable and can be controlled with respect to the play surface by a player thereby allowing a player to exercise some control over the drop of the coin from said coin chute to said play surface.

15. The amusement device as recited in claim 1 further comprising a target at a point in a trajectory defined by said coin chute, wherein the said time calculated and correlated with the moving indicator reflects the time a coin inserted into said coin acceptor appears to hit said target.

16. The amusement game recited in claim 15 wherein said target is fixed and serves to deflect coins to said playing surface.

* * * * *